US009187868B2

(12) United States Patent
Smieja et al.

(10) Patent No.: US 9,187,868 B2
(45) **Date of Patent: *Nov. 17, 2015**

(54) SCREED EXTENSION SLIDING SUPPORT SYSTEM

(71) Applicant: Caterpillar Paving Products Inc., Minneapolis, MN (US)

(72) Inventors: Jameson Smieja, Mound, MN (US); Dean Diers, Sturgis, SD (US); John Jorgensen, Andover, MN (US); Brett Engel, Milwaukee, WI (US)

(73) Assignee: Caterpillar Paving Products, Inc., Brooklyn Park, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/724,291

(22) Filed: May 28, 2015

(65) Prior Publication Data

US 2015/0284919 A1 Oct. 8, 2015

Related U.S. Application Data

(63) Continuation of application No. 13/875,333, filed on May 2, 2013, now Pat. No. 9,074,329.

(51) Int. Cl.
*E01C 19/48* (2006.01)

(52) U.S. Cl.
CPC ..... *E01C 19/4873* (2013.01); *E01C 2301/16* (2013.01)

(58) Field of Classification Search
CPC ..... E04F 21/24; E04F 21/241; E04F 21/242; E01C 19/402; E01C 19/48; E01C 19/40; E01C 19/405; E01C 19/42; E01C 19/24; E01C 2301/16; E01C 2301/14; E01C 2301/20
USPC ..... 404/101, 104, 118, 119, 122, 123
See application file for complete search history.

(56) References Cited

U.S. PATENT DOCUMENTS

| | | | |
|---|---|---|---|
| 3,155,021 | A | 11/1964 | Sauer et al. |
| 3,415,173 | A | 12/1968 | Paul |
| 3,673,930 | A | 7/1972 | Birtchet |
| 3,702,578 | A | 11/1972 | Davin |
| 5,046,888 | A | 9/1991 | King |
| 5,203,642 | A | 4/1993 | Heller et al. |
| 6,019,544 | A | 2/2000 | Emerson et al. |
| 6,056,474 | A | 5/2000 | Nolan |
| 6,059,489 | A | 5/2000 | Heims |
| 6,190,087 | B1 | 2/2001 | Rower |
| 6,543,962 | B2 | 4/2003 | Wells |
| 6,595,719 | B1 | 7/2003 | Ohseki et al. |
| 7,651,295 | B2 | 1/2010 | Eppes et al. |
| 8,221,026 | B2 | 7/2012 | Munz et al. |
| 8,267,619 | B2 | 9/2012 | Munz |
| 8,591,145 | B1 | 11/2013 | Engel et al. |

*Primary Examiner* — Abigail A Risic

(74) *Attorney, Agent, or Firm* — Andrew A. Phillips; Miller, Matthias & Hull LLP

(57) ABSTRACT

A screed assembly includes a screed and a screed extension, with the screed coupled to the screed extension. The screed further includes an upper frame and a lower frame. The lower frame is adapted to move in a substantially vertical direction and movement in a substantially vertical direction of the lower frame results in corresponding substantially vertical movement of the screed extension.

26 Claims, 4 Drawing Sheets

SCREED EXTENSION SLIDING SUPPORT SYSTEM

CROSS-REFERENCE TO RELATED APPLICATION

This patent application is a continuation, under 35 U.S.C. §120, of U.S. patent application Ser. No. 13/875,333, filed May 2, 2013.

TECHNICAL FIELD

The present disclosure relates generally to an extension mounting system for coupling a screed extension to a screed, and more particularly to a sliding support system that allows the screed and screed extension to move vertically together while remaining connected.

BACKGROUND

A paving machine, such as an asphalt paver, is generally a self-propelled machine designed to receive, convey, distribute, and partially compact paving material, such as asphalt. Typically, the paving machine receives the paving material in a hopper positioned at the front of the machine, conveys the paving material from the hopper to the rear of the machine with parallel slat conveyors, distributes the paving material along a desired width, and compacts the paving material into a mat with a screed. The width of the screed, which may be adjustable, typically defines the paving width provided by the particular paving machine. In particular, some paving machines include frame portions that are hydraulically extendible in a substantially lateral direction to increase the paving width. Mechanical extensions, or screed extensions, may also be utilized for increasing the paving width provided by the base screed.

Mechanical extensions can be relatively heavy and typically require an additional piece of equipment, such as a forklift or crane, for lifting the mechanical extension into alignment with the base screed. Once the mechanical extension and base screed are aligned, they are bolted together to secure and maintain the proper positioning of the mechanical extension. Often, these bolted connections are numerous and difficult to access. Thus, attaching a mechanical extension to a base screed, particularly when conducted in the field, can be difficult, time-consuming, costly, and may require equipment that is not readily available.

U.S. Pat. No. 6,190,087 to Rower teaches a paver screed having a main screed with two outer side walls, at least one of the side walls being provided with insertion orifices for the releasable mounting of at least one lateral screed extension by means of fastening elements capable of being inserted through the insertion orifices. Rower further teaches a screed extension having fastening elements that comprise hydraulic cylinders which each have a piston that is spring-biased into an initial, retracted position. Rower does not teach an extendible screed or a screed that can be moved in a vertical direction. Nor does Rower teach that movement of the screed in a vertical direction results in corresponding vertical movement of a screed extension.

The present disclosure is directed to one or more of the problems or issues set forth above.

SUMMARY OF THE DISCLOSURE

In one aspect, a screed assembly includes a screed and a screed extension, with the screed coupled to the screed extension. The screed includes an upper frame and a lower frame. The lower frame is adapted to move in a substantially vertical direction and movement in a substantially vertical direction of the lower frame results in corresponding substantially vertical movement of the screed extension.

In another aspect, a screed assembly includes an extender and an extension. The extender has an extender plate and the extension has an extension plate. The extender is coupled to the extension and the extender plate is capable of substantially vertical movement. When the extender plate undergoes substantially vertical movement, the extender plate and the extension plate travel substantially equal distances.

In yet another aspect, a paving machine includes a tractor, a screed, and a screed extension. The tractor is coupled to the screed and the screed is coupled to the screed extension. The screed includes an upper frame and a lower frame. The lower frame is adapted to move in a substantially vertical direction and movement in a substantially vertical direction of the lower frame results in corresponding substantially vertical movement of the screed extension.

DETAILED DESCRIPTION

Figure 1:
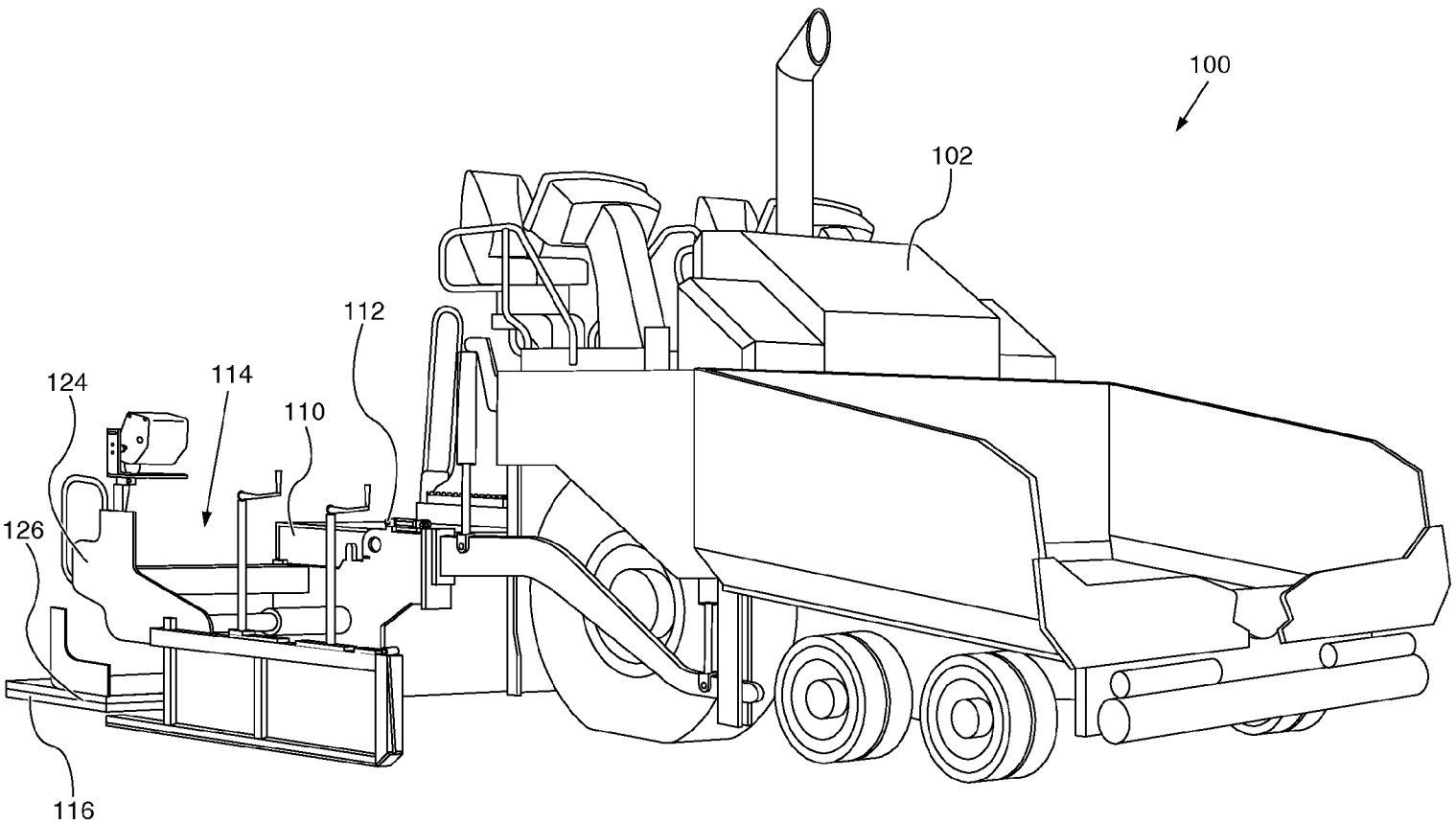
FIG. 1 is a perspective view of a paving machine having a screed with an extendible frame portion, according to the present disclosure.

An exemplary embodiment of a paving machine 100 is shown generally in FIG. 1. Paving machine 100, which may also be referred to as an asphalt paver, may be any machine used to distribute a layer of paving material on the surface of a roadway or other area. Paving machine 100 generally includes a tractor portion 102 including a power source, such as an internal combustion engine, ground-engaging propulsion elements, some or all of which may be powered by the power source, and an operator control station. Tractor portion 102 of paving machine 100 may also include hydraulic drives and controls, along with various other known paving machine components, for operating various systems and components of paving machine 100. Paving machine 100 may also support various other components and systems, including a hopper supported on a front portion for receiving the paving material.

Paving machine 100 may also include a conveyor for conveying the paving material received within the hopper to a screed 110, such as a free floating screed, coupled with the paving machine 100, such as via tow arms, at a rear portion of the paving machine 100. Screed 110 may smooth and, at least partially, compact the paving material into a mat on the desired paving surface. Screed 110 may include a main frame 112, a screed extender 114, and a screed plate 116. Main frame 112 is the portion of screed 110 located directly behind the tractor 102. Screed extender 114 is the portion of screed 110 that extends out from main frame 112. Screed extender 114 can be hydraulically actuated by the operator of paving machine 100 or screed 110 to extend and retract as needed to wide or narrow screed 110 to lay the appropriate mat for a particular paving job. Screed 110 includes a screed plate 116 at the bottom portion of the screed 110 that flattens and compresses the paving material. Screed 110 of paving machine 100 may also include additional components and systems, such as, for example, leveling arms, vibrators, sensors, and controllers. Such additional systems and components are not within the scope of the present disclosure and, thus, will not be discussed herein in greater detail.

Screed extender 114 includes an upper frame 124 and a lower frame 126. Screed plate 116 is part of lower frame 126. The position of screed extender 114 may be adjusted with respect to height, slope, and extender width. Each of these functions may be carried out by the operator of either paving machine 100 or screed 110. The height of screed extender 114 can be adjusted through the vertical movement of the screed plate 116 of the screed extender 114 relative to the paving surface. When the height of screed plate 116 is adjusted, lower frame 126 moves up and down, resulting in the movement of screed plate 116. During this vertical movement, upper frame 124 remains fixed. Usually the height system is actuated to bring the rear edge of screed plate 116 of screed extender 114 into alignment with the rear edge of screed plate 116 of main frame 112. For the sake of clarity, when reference is made to adjusting the height of screed extender 114 or lower frame 126, that means the movement of lower frame 126 that adjusts the height of screed plate 116 in a substantially vertical direction. Slope movement refers to angling screed extender 114 relative to main frame 112. Extender width refers to the lateral distance screed extender 114 extends from main frame 112, which dictates the overall width of screed 110.

Oftentimes it is desired to pave a surface that is wider than the maximum width of screed 110 with screed extender 114 fully extended. In such cases, operators may create a screed assembly 120, such as the one shown in FIG. 2. Screed assembly 120 includes screed 110 having screed extender 114 along with a screed extension 130. Screed extension 130 has its own screed plate 132. Screed extension 130 allows the operator to add additional paving width to paving machine 100. Screed extension 130 is typically bolted onto screed 110 at lower frame 126. In addition, multiple screed extensions and screed extensions of varying lengths can be attached to screed 110. As an example, screed extension 130 is shown as two screed extensions of two different lengths in FIG. 2.

Figure 2:
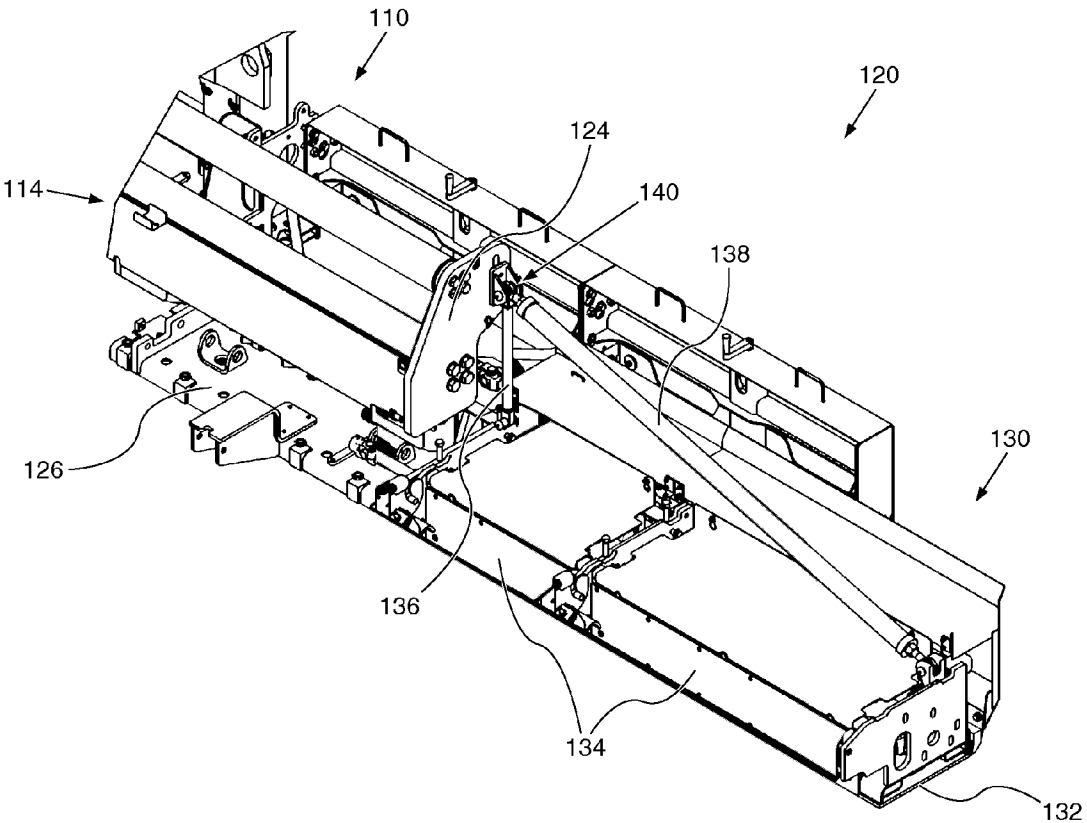
FIG. 2 is a diagrammatic view of a portion of a screed assembly, according to an aspect of the present disclosure.

According to an embodiment of the present disclosure, screed extension 130 includes frame 134, vertical support 136, tie rod 138, and sliding joint assembly 140. Screed extension plate 132 is connected to frame 134. Vertical support 136 is coupled to sliding joint assembly 140 and to frame 134. Vertical support 136 may be coupled to frame 134 through an intermediate member. Tie rod 138 is coupled to sliding joint assembly 140 and frame 134. Frame 134 may include a single bolt on extension or multiple bolt on extensions, as shown in FIG. 2. Tie rod 138 is adjustable in length, and its length is set when initially assembling screed assembly 120. After frame 134 is bolted onto lower frame 126, tie rod 138 is coupled to sliding joint assembly 140 and frame 134. Tie rod 138 is then set, and tie rod 138 is coupled to sliding joint assembly 140 and frame 134, the length of tie rod 138 remains fixed and will not be adjusted until alterations to the screed assembly 120 are made.

Figure 3:
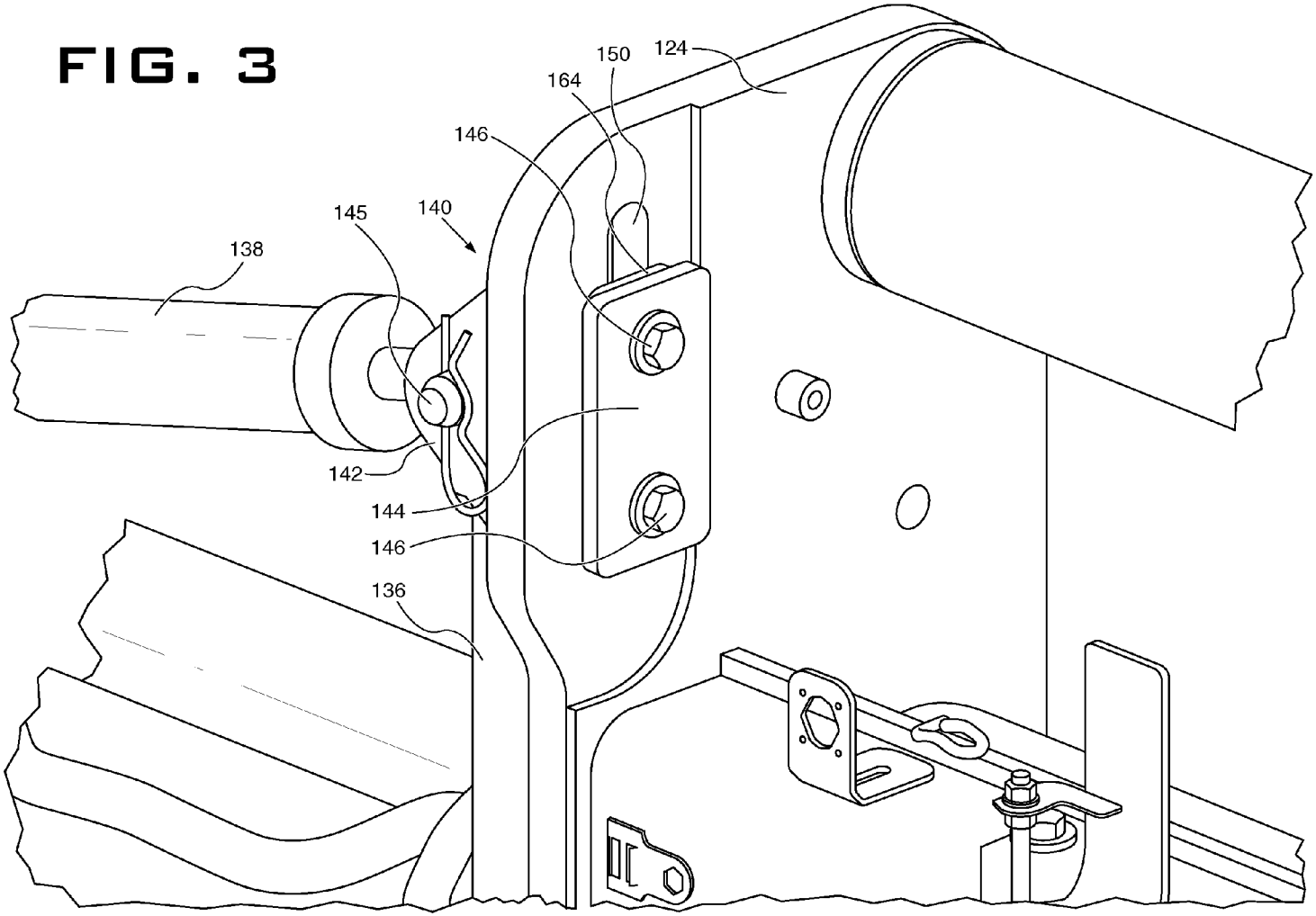
FIG. 3 is a diagrammatic view depicting a sliding joint assembly for a screed assembly, according to another aspect of the present disclosure.
Figure 4:
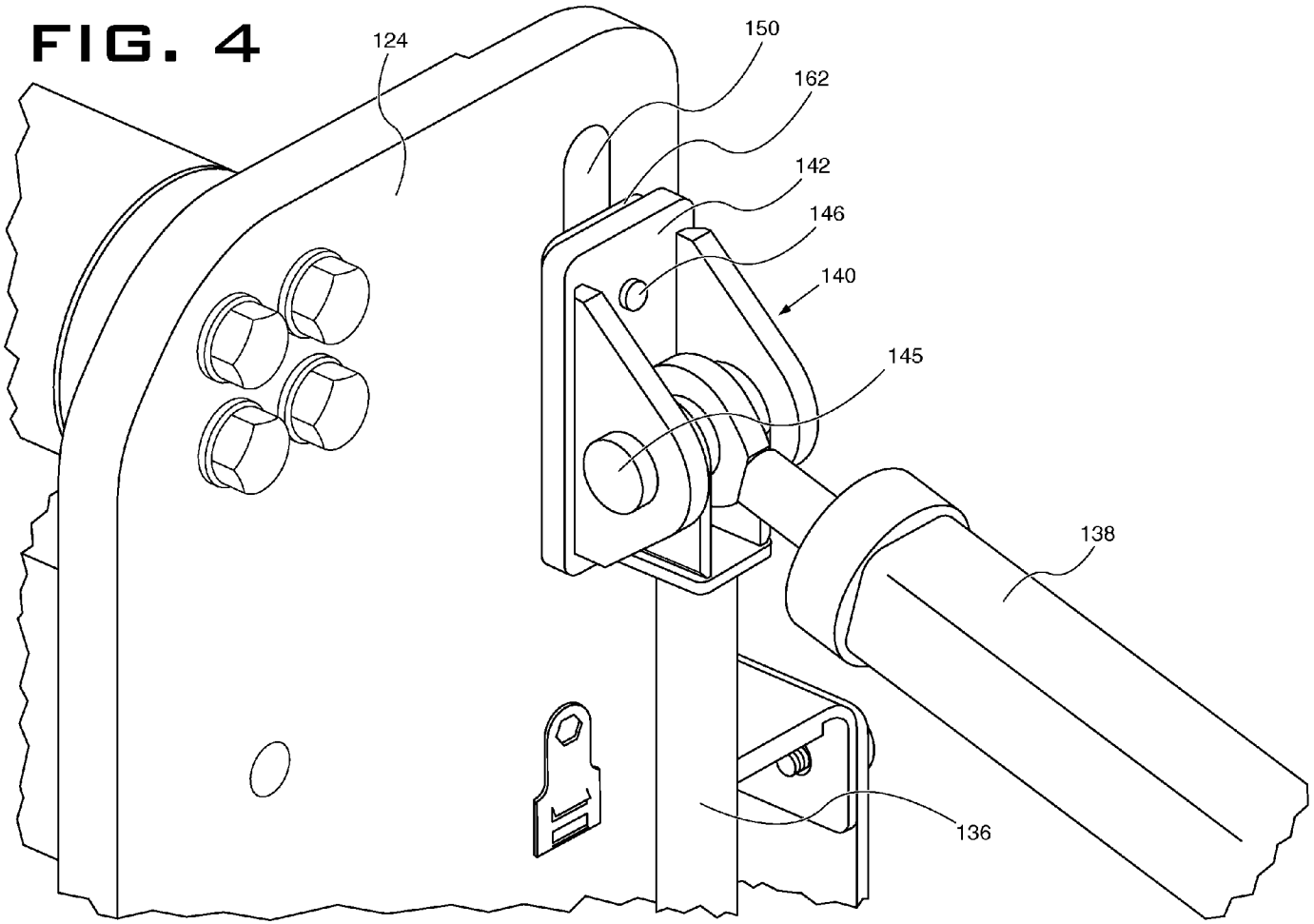
FIG. 4 is a diagrammatic view of the sliding joint assembly of FIG. 3.

Sliding joint assembly 140 is shown in FIGS. 3 and 4 from different perspectives. FIG. 3 shows sliding joint assembly 140 angled from the back, or from screed extender 114 towards screed extension 130. FIG. 4 shows sliding joint assembly 140 angled from the front, or from screed extension 130 towards screed extender 114. Sliding joint assembly 140 is in communication with upper frame 124. Upper frame 124 includes an opening 150. Sliding joint assembly 140 moves vertically along opening 150.

Sliding joint assembly 140 includes a mounting bracket 142, a plate 144, pin 145, two fasteners 146, a wear pad 162, and a wear block 164. Mounting bracket 142 is disposed on the screed extension side of upper frame 124. Mounting bracket 142 includes a pair of opposing walls, having aligned openings to receive pin 145. Plate 144 is disposed on the screed side of upper frame 124. Between mounting bracket 142 and upper frame 124 is wear pad 162. A wear block 164 is also located between plate 144 and upper frame 124. Two fasteners 146 couple the section of sliding joint assembly 140 disposed on the screed side of upper frame 124 to the section of sliding joint assembly 140 disposed on the screed extension side of upper frame 124. That is, fasteners 146 couple mounting bracket 142, plate 144, wear pad 162, and wear block 164 together. Fasteners 146 and wear block 164 extend through opening 150 in upper frame 124.

Pin 145 extends through the aligned opening of mounting bracket 142 and serves to couple vertical support 136 and tie rod 138 to sliding joint assembly 140. In the embodiment shown, vertical support 136 and tie rod 138 are capable of rotating around pin 145 for ease of coupling and adjustment.

INDUSTRIAL APPLICABILITY

The present disclosure finds potential application in any paving machine 100 that utilizes screed extensions 130 to increase paving width. Further, the disclosure may be applicable to mechanical or rigid screed extensions 130 for paving screeds 110 that have extendible and pivotable frame portions. Further, the disclosure may be specifically applicable to mounting systems and methods for attaching the screed extension 130 to an extendible and pivotable frame portion of a screed 110 to define a screed assembly 120.

The present disclosure allows vertical movement of screed extender 114 while the screed extension 130 is bolted on to it. Previously, screed tie rod 138 and/or mounting bracket 142 would need to be disassembled from screed extender 114 before vertical movement could take place, and then reassembled onto screed extender 114 after the vertical adjustment was made. This would not allow the tie rod to maintain proper support and screed plate alignment whenever a vertical adjustment was needed. With the present disclosure, when lower frame 126 is vertically actuated, sliding joint assembly 140 travels vertically in opening 150 in upper frame 124, saving the operator from putting the screed plate alignment out of adjustment and then having to readjust the flatness between screed plates 132 and 116. Both screed plate 116 and screed plate 132 will travel roughly equal distances in vertical height relative to upper frame 124, when the height functionality is actuated.

The present disclosure allows screed plate 116 of screed extender 114 to stay in line with screed plate 132 of screed extension 130. In other words, screed plate 116 and screed plate 132 should lie generally along the same plane. Screed extension 130 may also be coupled to screed extender 114 when screed extender 114 is moved in a substantially lateral direction. References in the present disclosure have been made to movements in a substantially vertical or lateral direction. These references are to clarify that movements are generally in the direction indicated, although movement is not necessarily constrained to being only in that direction.

While reference has been made to sliding joint assembly 140 containing mounting bracket 142, steel plate 144, pin 145, fasteners 146, wear pad 162, and wear block 164, sliding joint assembly 140 need not be limited to having all or any of these features. For example, sliding joint assembly need not be formed of multiple parts, but may be two pieces, one on each side of opening 150. Also, wear pad 162 and wear block 164 may not need to be separate pieces. It is also envisioned that mounting bracket 142 and steel plate 144 may be connected by other methods than fasteners 146, such as welding, or that fasteners 146 could be positioned differently in sliding joint assembly 140.

While reference has been made to sliding joint assembly 140 being connected to vertical support 136 and tie rod 138 by pin 145, sliding joint assembly 140, vertical support 136, and tie rod 138 could be connected by any method that would allow them to be assembled and disassembled in a short amount of time, due to the need for extension 130 to be connected and disconnected from extender 114 in an efficient manner to maximize operator productivity.

While the present disclosure describes sliding joint assembly 140 traveling in a substantially vertical direction along opening 150, the present disclosure is not limited to such a design. For example, sliding joint assembly 140 may be constructed to engage a track-type system located on the outer surface of upper frame 124. Additionally, instead of having vertical movement come from the hydraulic system of screed 110, other systems such as an electric motor are envisioned by the present disclosure. While the present disclosure described substantially vertical movement of lower frame 126 causing the substantially vertical movement of extension 130, sliding joint assembly 140 could be constructed with its own hydraulic actuation system, battery system, or an electric motor that, in conjunction with a control system, would allow substantially vertical movement. Indeed, any system that allows corresponding substantially vertical movement of extender 114 and extension 130 is contemplated by the present disclosure. Extender 114 and extension 130 should travel almost similar vertical distances when the operator commences actuation of the height functionality.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure, and the appended claims.

What is claimed is:

1. A screed assembly comprising:

a screed comprising an upper frame and a lower frame;

a screed extension;

a first support member coupled to the screed extension and to the screed upper frame;

a coupling between the first support member and the screed upper frame, the coupling being substantially vertically displaceable relative to the upper frame;

the lower frame configured to move in a substantially vertical direction while the upper frame remains stationary; and the screed extension configured to move in a substantially vertical direction with the movement of the lower frame in a substantially vertical direction.

2. The screed assembly of claim 1, wherein the coupling is a sliding joint assembly.

3. The screed assembly of claim 2, further comprising a second support member coupled to the screed extension and to the screed upper frame.

4. The screed assembly of claim 3, wherein the sliding joint assembly is coupled to the first support member and the second support member.

5. The screed assembly of claim 2, wherein the screed extension is coupled to the screed by coupling a screed extension frame to the screed lower frame and by coupling the sliding joint assembly to the screed upper frame.

6. The screed assembly of claim 1, wherein the first support member is a tie rod.

7. The screed assembly of claim 1, wherein the screed further comprises a screed plate and the screed extension further comprises a screed extension plate, and wherein the screed plate and the screed extension plate remain substantially aligned when the lower frame is moved in a substantially vertical direction.

8. A method for assembling a screed extension system, the method comprising:

providing a screed having a screed plate, an upper frame and a lower frame;

providing a screed extension having a screed extension plate and a first support member extending from the screed extension;

attaching the screed extension to the screed lower frame; and attaching the first support member to the screed upper frame, the attachment between the first support member and the screed upper frame being substantially vertically displaceable relative to the screed upper frame.

9. The method of claim 8, further comprising aligning the screed plate with the screed extension plate.

10. The method of claim 8, further comprising adjusting a length of the first support member.

11. The method of claim 8, wherein the first support member is a tie rod.

12. The method of claim 8, further comprising attaching a second support member between the screed extension and the screed upper frame.

13. The method of claim 8, wherein the attachment is a sliding joint assembly.

14. A method for adjusting the height of a screed and screed extension, the method comprising:

providing a screed having a screed plate, an upper frame and a lower frame;

providing a screed extension attached to the screed lower frame, the screed extension having a screed extension plate and a first support member extending from the screed extension and coupled to the screed upper frame; and actuating vertical movement of the screed lower frame while the screed upper frame remains stationary, vertical movement of the screed lower frame resulting in corresponding substantially vertical movement of the screed extension and substantially vertical displacement of a coupling between the first support member and the screed upper frame.

15. The method of claim 14, wherein the coupling between the first support member and the upper frame is a sliding joint assembly.

16. The method of claim 15, wherein the screed extension includes a second support member extending from the screed extension and coupled to the screed upper frame.

17. The method of claim 16, wherein actuating vertical movement of the screed lower frame results in substantially vertical displacement of a coupling between the second support member and the screed upper frame.

18. A paving machine comprising:

a tractor;

a screed comprising an upper frame and a lower frame;

a screed extension;

a first support member coupled to the screed extension and to the screed upper frame; and a coupling between the first support member and the screed upper frame, the coupling being substantially vertically displaceable relative to the upper frame;

wherein the tractor is coupled to the screed;

wherein the screed is coupled to the screed extension;

wherein the screed lower frame is configured to move in a substantially vertical direction while the screed upper frame remains stationary; and wherein movement in a substantially vertical direction of the screed lower frame results in corresponding substantially vertical movement of the screed extension.

19. The paving machine of claim 18, wherein the coupling is a sliding joint assembly.

20. The paving machine of claim 19, further comprising a second support member, and wherein the first support member is coupled to a screed extension frame, the second support member is coupled to a screed extension frame, and the sliding joint assembly is coupled to the first support member and the second support member.

21. The paving machine of claim 18, wherein the first support member is a tie rod.

22. The paving machine of claim 18, wherein the screed further comprises a screed plate and the screed extension further comprises a screed extension plate, and wherein the screed plate and the screed extension plate remain substantially aligned when the lower frame is moved in a substantially vertical direction.

23. A screed assembly comprising:

a screed, the screed further comprising an upper frame and a lower frame;

a screed extension;

wherein the screed is coupled to the screed extension;

wherein the lower frame is adapted to move in a substantially vertical direction;

wherein movement in a substantially vertical direction of the lower frame results in corresponding substantially vertical movement of the screed extension;

the screed further comprises an extendible portion;

wherein the extendible portion is extendible in a substantially lateral direction;

wherein the screed extension comprises an extension frame, a first support member, a second support member, and a sliding joint assembly;

wherein the first support member is coupled to the extension frame, the second support member is coupled to the extension frame, and the sliding joint assembly is coupled to the first support member and the second support member;

wherein the screed extension is coupled to the screed by coupling the extension frame to the lower frame and by coupling the sliding joint assembly to the upper frame;

wherein the upper frame comprises an opening and the sliding joint assembly travels along the opening; and wherein the sliding joint assembly comprises:

a mounting bracket;

a plate;

a first wear pad; and a fastener.

24. The screed assembly of claim 23, wherein the sliding joint assembly further comprises:

a second wear pad;

wherein the mounting bracket and a first wear pad are disposed on a first side of the upper frame and the plate and the second wear pad are disposed on a second side of the upper frame;

wherein the first wear pad is between the mounting bracket and the first side of the upper frame;

wherein the second wear pad is between the plate and the second side of the upper frame; and wherein the fastener adheres the mounting bracket, first wear pad, second wear pad, and the plate together.

25. A paving machine comprising:

a tractor;

a screed, the screed further comprising an upper frame and a lower frame;

a screed extension;

wherein the tractor is coupled to the screed;

wherein the screed is coupled to the screed extension;

wherein the lower frame is adapted to move in a substantially vertical direction;

wherein movement in a substantially vertical direction of the lower frame results in corresponding substantially vertical movement of the screed extension;

wherein the screed further comprises an extendible portion;

wherein the extendible portion is extendible in a substantially lateral direction;

wherein the screed extension comprises an extension frame, a first support member, a second support member, and a sliding joint assembly;

wherein the first support member is coupled to the extension frame, the second support member is coupled to the extension frame, and the sliding joint assembly is coupled to the first support member and the second support member;

wherein the upper frame comprises an opening and the sliding joint assembly travels along the opening; and wherein the sliding joint assembly comprises:

a mounting bracket;

a plate;

a first wear pad; and a fastener.

26. The paving machine of claim 25, wherein the sliding joint assembly further comprises:

a second wear pad;

wherein the mounting bracket and a first wear pad are disposed on a first side of the upper frame and the plate and the second wear pad are disposed on a second side of the upper frame;

wherein the first wear pad is between the mounting bracket and the first side of the upper frame;

wherein the second wear pad is between the plate and the second side of the upper frame; and wherein the fastener adheres the mounting bracket, first wear pad, second wear pad, and the plate together.

* * * * *